US010081858B2

(12) United States Patent
Umarov et al.

(10) Patent No.: US 10,081,858 B2
(45) Date of Patent: Sep. 25, 2018

(54) METHOD OF IMPROVEMENT OF MECHANICAL PROPERTIES OF PRODUCTS MADE OF METALS AND ALLOYS

(75) Inventors: Georgy Ramasanovich Umarov, Moscow (RU); Sergey Ivanovich Boychenko, Moscow (RU); Shiv Vikram Khemka, Sachseln (CH)

(73) Assignee: SOLARIS HOLDINGS LIMITED, St. Helier, Jersey, Channel Islands (GB)

( * ) Notice: Subject to any disclaimer, the term of this patent is extended or adjusted under 35 U.S.C. 154(b) by 683 days.

(21) Appl. No.: 14/363,181

(22) PCT Filed: Aug. 28, 2012

(86) PCT No.: PCT/IB2012/001945

§ 371 (c)(1),
(2), (4) Date: Oct. 6, 2014

(87) PCT Pub. No.: WO2013/084034

PCT Pub. Date: Jun. 13, 2013

(65) Prior Publication Data

US 2015/0047748 A1 Feb. 19, 2015

(30) Foreign Application Priority Data

Dec. 7, 2011 (GB) ..... 1121197.6

(51) Int. Cl.

| | |
|---|---|
| ***C23C 8/24*** | (2006.01) |
| ***C23C 8/26*** | (2006.01) |
| ***C23C 8/04*** | (2006.01) |
| ***C23C 8/80*** | (2006.01) |

(52) U.S. Cl.

CPC ..... *C23C 8/26* (2013.01); *C23C 8/04* (2013.01); *C23C 8/24* (2013.01); *C23C 8/80* (2013.01)

(58) Field of Classification Search

CPC .... C23C 8/24; C23C 8/26; C23C 8/30; C23C 8/32

See application file for complete search history.

(56) References Cited

U.S. PATENT DOCUMENTS 4,511,411 A 4/1985 Brunner et al.

FOREIGN PATENT DOCUMENTS

| | | | |
|---|---|---|---|
| DE | 19652125 | C1 | 4/1998 |
| EP | 0408168 | A1 | 1/1991 |
| EP | 1 544 318 | A1 | 6/2005 |
| JP | S58039775 | A | 3/1983 |
| JP | S59140372 | A | 8/1984 |
| JP | S6248408 | A | 3/1987 |
| JP | 2005264238 | A | 9/2005 |
| JP | 2006131941 | A | 5/2006 |
| JP | 2010058164 | A | 9/2008 |
| RU | 2109080 | C1 | 4/1998 |
| RU | 2133299 | C1 | 7/1999 |
| RU | 2148676 | C1 | 5/2000 |
| RU | 2208659 | C1 | 7/2003 |
| WO | 95/29269 | A1 | 11/1995 |

OTHER PUBLICATIONS

International Search Report dated Feb. 26, 2013 in connection with PCT/IB2012/001945.

Search Report dated Mar. 27, 2012, in connection with GB1121197.6.

Guinan, et al., Pressure and Temperature Derivatives of the Isotropic Polycrystalline Shear Modulus for 65 Elements, Journal of Physics and Chemistry of Solids, 1974, 35(11):1501-1512.

Steinberg, et al., A Constitutive Model for Metals Applicable at High-Strain Rate, Journal of Applied Physics, 1980, 51:1498-1504.

*Primary Examiner* — Jessee Roe

(74) *Attorney, Agent, or Firm* — Quarles & Brady LLP

(57) ABSTRACT

The invention pertains to the domain of metallurgy in particular, thermochemical surface treatment of products made of metals, mainly steels, and their alloys and it can be used for products hardening for the purpose of their service durability increase.

The method of improvement of mechanical properties of products made of metals, mainly steels and alloys on their basis includes products nitriding in the gas atmosphere containing nitrogen and-or its compounds in the presence of a catalyst. Together the product and the catalyst are subject to hot isostatic pressing with observation of conditions of the barometric and temperature impact that provides achievement of dislocations density in the product's volume that satisfies conditions of transition of a part of the product substance into the positron state of the Dirac matter.

13 Claims, 1 Drawing Sheet

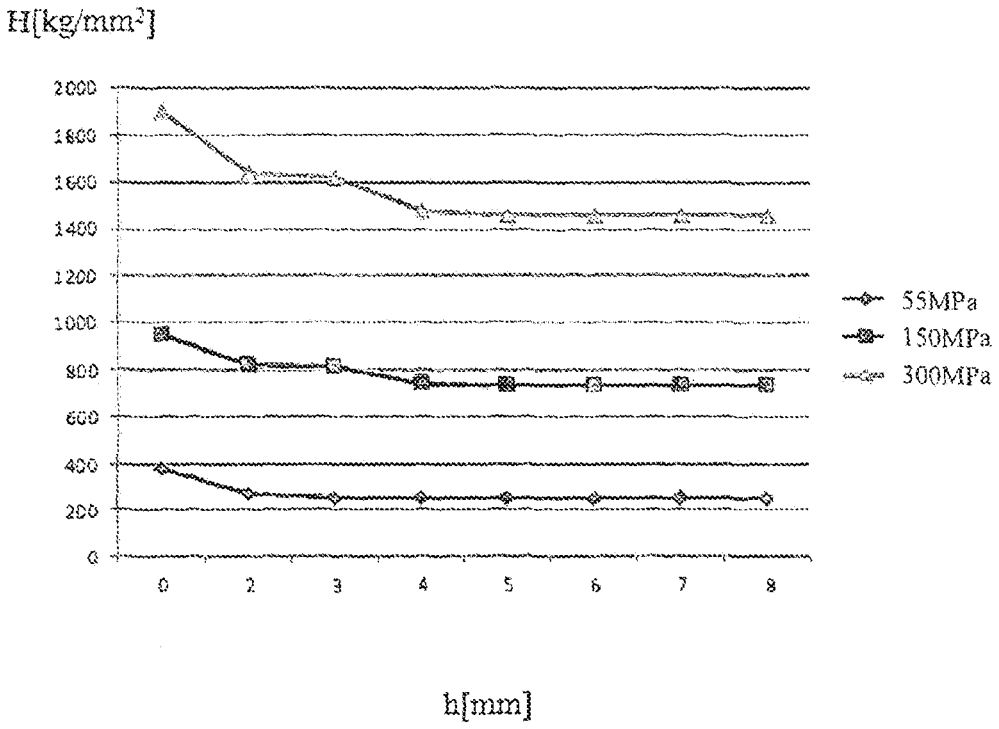
H[kg/mm²]
2000
1800
1600
1400
1200
1000
800
600
400
200
0
0
2
3
4
5
6
7
8
h[mm]
55MPa
150MPa
300MPa

METHOD OF IMPROVEMENT OF MECHANICAL PROPERTIES OF PRODUCTS MADE OF METALS AND ALLOYS

CROSS-REFERENCE TO RELATED APPLICATIONS

This application represents the national stage entry of PCT International Application No. PCT/IB2012/001945 filed Aug. 28, 2012, which claims priority of Great Britain Patent Application No. 1121197.6, filed Dec. 7, 2011, the disclosures of which are incorporated by reference here in their entirety for all purposes.

BRIEF DESCRIPTION OF THE DRAWING

FIG. 1 is a graph of experimental data on the distribution of microhardness in the depth of a layer of sample products material.

TECHNICAL FIELD

Invention pertains to the domain of metallurgy, in particular, to thermochemical surface treatment of products made of metals, mainly steels, and their alloys.

BACKGROUND ART

There are known methods of improvement of mechanical properties of metal and alloy products by means of hardening of their surface layers, for example, through nitride coating by nitriding the products at high temperature and pressure in the atmosphere of ammonia or mixed gas. The increase in hardness and deepness of a hardening layer is obtained by means of the product surfaces preprocessing, for example, with the help of alloying them with nitride-forming elements with the use of electron-beam technology (SU1707997, C23C 14/48, 1997) or with the help of laser heating (RU2148676 C1, C23C8/26, 2000) and with the subsequent annealing after the nitriding. The hardening is obtained by forming a structure that contains fine dispersed nitrides of alloying elements in the product surface layer. The hardness and depth of a hardened layer are determined by the speed of nitride depositing process that in its turn depends on accuracy of maintenance of an annealing temperature and on duration of this process.

There is known a method (RU2133299 C1, C23F17/00, 1999), which is based on a preliminary hot working of a detail by pressuring then cooling on air and then nitriding at the temperature, which excludes the recrystallizing of the detail structure, when diffusion flux is directed perpendicularly to a direction of deformation. In a material with a presence of a hot deformation texture nitrogen diffuses more intensively and formed nitrides are distributed more evenly and tightly, when the diffusion flux is directed perpendicularly to a direction of deformation. However this method is effective mainly for nitriding products made of low-carbon martensitic steels and is not suitable for low-ductility materials.

There are known methods of hardening of metal and alloy products by means of gas nitriding in the presence of catalysts—substances and compounds, which change the chemical reactions kinetics. Structure of catalysts as well as mechanisms of their influence can be various.

For example, in the method presented by the RU2208659C1, C23C8/30, 2003 patent, for the purposes of the surface nitrogen processing a high-temperature spherical form catalyst is used for a constrained circulation of a saturating gas-air mixture, within a working space in order to provide acceleration of isothermic and diffusion processes (so called "sandblasting" effect).

In the methods presented by the EPO408168, C23C 8/02, 1991; DE19652125, C23C 8/24, 1998 patents intensification of the nitriding process with the obtaining of deep hardened layers is provided by use of certain substances as a catalyst, which, enter into an interaction with superficial oxides and effectively peel a workpiece surface and conduce to its plastification.

There are known methods when fluxes of ammonia gas are preliminary exposed to a catalytic processing (RU2109080, C23C 8/24, 1998) with the help of catalysts of various chemical composition, for example, based on aluminum oxide, silicon oxide, or prepared from metals and their alloys which contain active catalytic elements of a variety of the metal-platinum group in their composition. Gas-containing atmosphere at the catalytic processing by the above mentioned elements and compounds attains a special activity in the way of a nitride impact on steel and alloy products whereas, by the inventors' opinion, labile, chemically highly active formations (nitrogen-, hydrogen-, oxygenated radicals, ions, ion-radicals) are the active components in the gas-containing medium penetrating into a firm metal matrix and reacting with it. The introduction of a catalytic factor during nitriding process, which specifically influences transformations of gas reagents allows purposefully and selectively managing all the spectrum of final and intermediate products obtained in the course of these processes. The above mentioned method permits to improve the process of the low-temperature surface impregnation (LTSI) of steels and alloys received on their basis (and to remove a number of problems arising in the LTSI process) because it provides the process of metal saturation by nitrogen in the conditions most proximate to the iron-nitrogen binary diagram, herewith the abilities of catalysts as activators of the nitriding process, are realized in the limited temperature range.

DISCLOSURE OF INVENTION

The aim of the present invention is the improvement of mechanical properties, in particular, the increase in hardness and impact strength of products made of metals, mainly steels, and alloys on their basis.

The technical result is the increase in depth and uniformity of high-strength but viscous layers by intensification of gas nitriding process. The intensification is provided by creation of an essentially new mechanism of influence on a product material, which enables penetration of nitrogen ions into the depth which is significantly greater than the regular one.

The additional result is the possibility of industrial processing of products from refractory and low-ductility materials, also large-sized products and products with the irregular shape.

The problem is solved in the following way: at the method of improvement of mechanical properties of products made of metals, mainly steels, and alloys on their basis that include nitriding in a gas atmosphere containing nitrogen and-or its compounds in the presence of the catalyst, the product and the catalyst simultaneously expose together to the hot isostatic pressing in combination with nitriding and with observation of conditions of the barometric and temperature impact that provides achievement of dislocations density in the product's volume which satisfies conditions of transition of a part of the product substance into the positron state of the Dirac matter.

The catalyst is used with the opportunity of composition of highly active mediums and/or compounds in the mentioned gas atmosphere that initiates occurrence of transient phases with forming positronium in the product's volume. The hot isostatic pressing is performed in a gasostat and nitriding of hollow products is carried out from their internal surface whereas the hot isostatic pressing is implemented at the barometric pressure from 100 to 300 MPa and temperature limits from 1500 to 2500° C. The elements of the 1 group of the Periodic system are used as the catalyst. At nitriding hollow products the catalyst is placed inside of a product and the hot isostatic pressing is carried out with the use of elements of the product's design.

After completion of the nitriding process the decontamination of the product and its depuration from impurity elements is implemented by annealing.

The essence of a method can be explained as follows.

It is determined that in a stable phase state of both a processing material and a saturating atmosphere the nitriding is ineffective because of the low diffusion of nitrogen caused by small plasticity and high resistance of metal deformation, while the most intensive saturation of a firm metal matrix by nitrogen occurs in the conditions of the phases transformation. In this case nitrogen diffuses more intensively while appearing nitrides are distributed more regularly and densely.

The conditions of instability of a phase state of a product's material are received through influencing the product and the present catalyst by the hot isostatic pressing (hereafter referred to as HIP). The feature of HIP is that this process allows setting the large plastic deformations without changing the shape of a sample.

At plastic deformation the density of dislocations—the major kind of defects in the crystal structure, a source of internal pressure in a crystal, grows. The line of a dislocation—the places of the maximal distortion of a crystal lattice. Actually, plastic deformation occurs due to the movement and multiplication of dislocations. Plasticity and viscosity of metal are the consequence of sufficiency of dislocations and planes on which they slide whereas the deformation hardening is caused by density of dislocations and strengthening of their interaction.

Atoms near to dislocations are displaced from their balance positions and their shift to new positions in the deformed crystal demands less energy input than for atoms in an undistorted crystal. The dislocations cannot appear only as a result of a thermal movement. The crystal high-temperature deformation is necessary for their origin and for increase in the slide path of the dislocations already arisen during formation of the crystal. In the conditions of the high-temperature deformation not only the density of dislocations increases but also the speed of diffusion in the crystal while the chemical stability of it decreases. The more is the zone of distortions in a vicinity of dislocations the less is the energy barrier to dislocations displacement determined by the energy of interatomic bonding. In this regard, the structure of the crystal is deformed near the line of a dislocation with distortion attenuation in inverse proportion to the distance from this line. Deformation of a real crystal begins, when the external pressure reaches the value necessary for the beginning of the dislocations movement that is the break of interatomic bonds near a dislocation.

It is known also, that only under influence of an external pressure there are dislocations with the symmetry having curvature different from zero among which the most perspective are axisymmetric screw spirals from the point of view of energy sector for tasks solved by the current invention.

The screw dislocation corresponds to an axis of the spiral structure in the crystal that is characterized by distortion which together with normal parallel planes forms the continuous screw inclined plane rotating as regard to a dislocation.

The HIP, which is based on the known Pascal law, assumes placing of a product in gaseous (or liquid) media on which a certain pressure affects, which is, in the result, distributed regularly on a surface of the product causing its compression in many directions. The primary goal of HIP is the increase in density of the products having closed defects. This technology allows materials of the product to obtain high strength and plastic properties that in many cases considerably exceed the levels achievable at hot deformation, for example. As the result of the hot isostatic impact on a product, in its volume there appear tensions causing infringements of periodicity of two-dimensional type in a crystal lattice (causing change in the density of dislocations) along which there is a diffusion of saturant in the volume. It is easy for interstitial atoms to move to the area of the stretched (deformed) crystal lattice. The channels of distortion are the channels of the facilitated diffusion.

For the mathematical description of the processes of deformation of metals, various models of elastoplastic behavior of a material are used. The important component of the model is dependence of elastic constants, and in case of isotropic materials (that metals are) the modulus of shearing G, from a thermodynamic status variables—the pressure and temperatures. There is the Steinberg model (Guinan M. W., and Steinberg D. J. Pressure and temperature of the isotropic polycrystalline shear modulus for 65 elements. J. Phys. Chem. Solids, 1974, vol. 35, pp. 1501-1512) [1] in which the dependence of the shear modulus on temperature and pressure is taken as the following:

$$G(P,T)=G_0[1+AP/\delta^{1/13}-B(T-T_0)],$$

where: G—the shear modulus $G_0$—value of the shear modulus under the normal conditions P=0, $T=T_0=300$ K A, B—the constants dependent on product substance properties and are received in the result of the analysis of the experimental information, submitted in Steinberg D. J., Cohran S. G., Guinan M. W. A constitutive model for metals at high-strain rate. J. Appl. Phys., 1980, vol. 51 (3), pp. 1498-1504 b d Steinberg D. J. Equation of state and strength properties of selected materials. LLNL report No. URCL-MA-106439, 1966 [2], $\delta=\rho/\rho_0$—the ratio of density of a product material under normal and the current conditions of a thermodynamic state.

Falling at a unit of length, energy of dislocations is determined by the effort necessary for creation of dislocations.

For a screw dislocation:

$$U_{screw}=\frac{Gb^2}{4\pi}\ln\left(\frac{r_1}{r_0}\right),$$

where: G—the shearing modulus, b—the Burgers vector, $r_0$, $r_1$—spherical coordinates of a point in dislocation line vicinity.

So, the amount of internal energy of a dislocation is proportional to the length of a dislocation and a square of the Burgers vector. Energy of all dislocational assembly (energy of a crystal lattice deformation) is defined by the overall length of dislocations and interdislocational distances, and, hence, by the density of dislocations.

$$U_{\Sigma}=U_{screw}V\eta,$$

where $\eta$—the density of dislocations.

From here the dependence of density of screw dislocations in the product's material on thermodynamic parameters of external influence is obvious.

The influence is implemented to achieve the so-called "critical" density of the screw dislocations, i.e. the density corresponding to the conditions of dislocations density in a substratum taking place in the positron state of the Dirac matter (or otherwise—in the fifth state of matter). Process of transition of a small part of the mentioned matter to the fifth state (at observance of certain conditions of a quantum-mechanical resonance realization) is accompanied by emission of a significant amount of energy promoting the increase in the speed and depth of diffusion of a saturant in the volume of the product. This statement is based on understanding of the essence of the fifth state of the Dirac matter (stated in the monography "The Principles of Quantum Mechanics" by P. A. M. Dirac. Second Edition. Oxford, 1935 [3]) and the processes that take place in the product's material at its introduction into a quantum-mechanical resonance with the fifth state of matter mentioned in the writing of A. I. Ahiezer and V. V. Berestetsky "Quantum electrodynamics", Nauka, Moscow, 1969. [4].

The conditions for creating the quantum-mechanical resonance in a matter's microvolume are based on the energy conservation law and the impulse moment. As the initiating impact with the purpose of introduction the material into the mentioned matter's state it is necessary to create a certain density of energy onto a unit of volume of the matter and also a required density of impulse or its moment that causes polarizing processes at the positron state of the Dirac matter followed by actuation of particles and antiparticles where a positron antiparticle annihilates with the matter of the product allocating the necessary additional energy. The annihilation is accompanied by generation of single $\gamma$-photons which registration by the known available means allows judging on the achievement of the critical value by the dislocations density in the product's matter.

In view of the above-stated, it is possible to determine the barometric and temperature conditions of the hot isostatic pressing that allow introducing of a small part of the matter into a quantum-mechanical resonance with the positron state of the Dirac matter. The calculated interval of values of the HIP operational conditions, at which the maintenance tasks of the present invention are solved in the best way, is experimentally confirmed:

P=100 . . . 300 MPa

T=1500 . . . 2500° C.

In comparison with the atmospheric, the increase in the pressure of a sating atmosphere promotes intensification of absorbing processes on the surface of products being under processing on which there is a more intensive increase of concentration of saturant, This leads to an increase in a gradient of the concentration and, accordingly, to acceleration of diffusion processes. In addition to that (the Sivert's law), at increase of pressure of a saturating environment solubility of nitrogen in the metal enhances, that prevents developing of fragile nitride phases on a surface of hardening products.

The strengthening of the effect of the nitrogen diffusion intensification in thickness of a product's material is obtained by the use of catalysts—matters forming highly active connections with nitrogen which do not transform into the $\varepsilon$-phase. The feature of catalysts to change the kinetics of the nitriding reaction namely to increase the speed of the reaction course to promote splitting of nitrogen molecules into atoms, to increase the concentration of positively charged particles—ions including nitrogen and the catalyst hinders the fast hardening of the formed connections in the near-surface layer of a product and hence that rises a gradient of nitrogen diffusion in its volume that leads to the increase of concentration of the saturant nitrogen in the product.

The greatest effect is achieved at selection of the structure of the catalysts that provides creation of substances and connections which initiate phase transitions in the volume of a product with occurrence of the positronium, being an active reducer, at interaction with the saturating atmosphere in the conditions of the hot isostatic pressing. As is known, the similar type reactions (the reduction reaction) are accompanied by emission of a significant amount of energy. This circumstance and also the certain changes in the crystal lattice related to the forming of the positronium strengthen the effect that begins in a material of a product under the impact of the hot isostatic pressing.

Elements of the 1 group of the Periodic system can be applied as the catalyst capable to provide the above described processes due to their following properties:

the smallest ionic radius (easily diffusing), available hydrogen-like spectrum, close quantum numbers providing the required magnetic and orbital moments, the required nuclear structure promoting the creation of positronium, the required energy level distance between which corresponds to the gamma-quantum energy ($2\ m_o c^2$, where $m_o$—electron mass, c—speed of light in vacuum).

BEST MODE FOR CARRYING OUT THE INVENTION

The process of the hot isostatic pressing can be implemented in a gasostat—the device for gasostatic processing in which nitrogenated gas is a working medium transmitting all-round influence. The gasostat design, namely a high pressure vessel included in its structure, provides necessary conditions of the barometric (up to 300 MPa) and temperature (up to 2500° C.) impact for the most effective implementation of the current method. A number of installations, for example, developed and designed in the USA (in the Batter institute) answer to these requirements. Together with a processable product a catalyst is loaded in gasostat. The nitriding of hollow products is expedient to be carried out through influencing their internal surface. In this case, for the treatment of large-sized hollow products it is possible to use their construction as elements of the gasostating device. For example, the internal cavity of an enough extended piece of a thick-walled pipe properly hermetically sealed at both butt ends can serve as a high pressure tank (by analogy with the gasostat) and can be filled by nitrogenated gas and catalyst.

As a result of a number of carried out experiments on hardening of products made of various structure steels the high microhardness of a material is achieved at significant depth of diffusion layer, the consequence of that is an increase in wear resistance of products by 2-10 times. Experimental data on the distribution of microhardness in the depth of a layer of a sample products material is illustrated by the graph of FIG. 1. The data is received at conditions of influencing the samples by the nitrogenated atmosphere with the temperature T=1050° C. and pressure 55, 150 and 300 MPa accordingly.

INDUSTRIAL APPLICABILITY

The invention can be used for hardening of metal and metal alloy products for the purpose of their service durability increase and can be applied in the metallurgy industry, oil-extracting, machine-building and other industries.

The invention claimed is:

1. A method of improvement of mechanical properties of a product made of metal includes nitriding the product in a gas atmosphere containing a catalyst and nitrogen and-or its compounds, and exposing the product and the catalyst simultaneously to hot isostatic pressing when the barometric pressure and temperature provides dislocations density in a volume of the product, wherein microhardness of the metal is increased.

2. The method according to claim 1 in which the catalyst is used with a composition of highly active mediums and/or compounds selected to initiate occurrence of transient phases with forming positronium in the product's volume.

3. The method according to claim 1 in which the hot isostatic pressing is performed in a gasostat.

4. The method according to claim 1 in which the product is hollow, and nitriding of the hollow products is carried out from the internal surface of the hollow product.

5. The method according to claim 1 in which the hot isostatic pressing is implemented at the barometric pressure from 100 to 300 MPa and temperature limits from 1500 to 2500° C.

6. The method according to claim 2 in which the elements of the 1 group of the Periodic system are used as the catalyst.

7. The method according to claim 4 in which the catalyst is placed into an internal cavity of the hollow product and elements of the hollow product's design are used for creating conditions for the hot isostatic pressing.

8. The method of claim 1, wherein the metal comprises at least one of steel and a steel alloy.

9. A method for hardening a product made of metal, the method comprising the following steps:

positioning the product in a gasostat containing nitrogenated gas;

loading a catalyst into the gasostat;

nitriding the product; and exposing the product and the catalyst simultaneously to hot isostatic pressure while a barometric pressure in the gasostat is in a range between 100 and 300 MPa and a temperature in the gasostat is in a range between 1500 and 2500 degrees C. to provide dislocations density in a volume of the product to increase microhardness of the material.

10. The method of claim 9, wherein the catalyst comprises an element of group I of the Periodic table.

11. The method of claim 9, wherein the metal is at least one of steel and a steel alloy.

12. The method of claim 9, wherein the temperature is 1050 degrees C.

13. The method of claim 9, wherein the barometric pressure is one of 150 MPa and 300 MPa.

* * * * *